US010155254B2

(12) United States Patent
Spekschate

(10) Patent No.: US 10,155,254 B2
(45) Date of Patent: Dec. 18, 2018

(54) PORTABLE CONTAINER CLEANING SYSTEM AND APPARATUS

(71) Applicant: OMNI Energy Services Corp., Carencro, LA (US)

(72) Inventor: Vincent P. Spekschate, Eunice, LA (US)

(73) Assignee: Omni Energy Services Corp., Carencro, LA (US)

( * ) Notice: Subject to any disclaimer, the term of this patent is extended or adjusted under 35 U.S.C. 154(b) by 242 days.

(21) Appl. No.: 14/969,910

(22) Filed: Dec. 15, 2015

(65) Prior Publication Data

US 2016/0175902 A1 Jun. 23, 2016

Related U.S. Application Data

(60) Provisional application No. 62/095,898, filed on Dec. 23, 2014.

(51) Int. Cl.

| | |
|---|---|
| ***B08B 9/08*** | (2006.01) |
| ***B08B 9/093*** | (2006.01) |
| ***B08B 3/02*** | (2006.01) |
| *B08B 3/14* | (2006.01) |
| *B65D 90/00* | (2006.01) |

(52) U.S. Cl.

CPC ..... *B08B 9/0826* (2013.01); *B08B 3/024* (2013.01); *B08B 9/093* (2013.01); *B08B 3/14* (2013.01); *B65D 90/0086* (2013.01)

(58) Field of Classification Search

CPC ..... B08B 9/0826

See application file for complete search history.

(56) References Cited

U.S. PATENT DOCUMENTS

| | | | | |
|---|---|---|---|---|
| 5,564,509 | A | 10/1996 | Dietzen | |
| 5,711,819 | A | 1/1998 | Miyasaki | |
| 6,796,379 | B1 | 9/2004 | Martin | |
| 7,232,525 | B2 | 6/2007 | Eriksen | |
| 7,261,109 | B2 * | 8/2007 | Luke | B08B 3/024 134/113 |
| 8,133,164 | B2 | 3/2012 | Beebe et al. | |

(Continued)

FOREIGN PATENT DOCUMENTS

RU 2486019 C2 6/2013

OTHER PUBLICATIONS

Martin Hunter et al.; Automatic mud tank cleaning system cut costs, risks; Offshore—Business Briefs—Offshore Digital Magazine; Sep. 1, 2010; Website article from www.offshore-mag.com/articles/print/volume-70/issue-9/drilling-_completion/automatic-mud-tank-cleaning-system-cuts-costs-risks.html Jereh Energy Services Corporation; JATC-80 Automated Tank Cleaning; Products & Services; Equipment Characterisitics; Website article from http://en.jereh-services.com/products/chanpintedian.htm.

(Continued)

*Primary Examiner* — Jason Y Ko

(74) *Attorney, Agent, or Firm* — Robert Devin Ricci; Lauren J. Rucinski; Kean Miller LLP

(57) ABSTRACT

A portable container cleaning apparatus comprising: a cleaning container comprising at least one cleaning platform lift door unit; a cleaning unit comprising at least one cleaning nozzle; a pump and piping system; and, a filtration system, wherein a portable container is capable of being loaded into a cleaning position inside said cleaning container via said cleaning platform lift door unit for cleaning by said cleaning unit, and said cleaning unit is in fluid communication with said filtration system via said pump and piping system.

21 Claims, 8 Drawing Sheets

(56) References Cited

U.S. PATENT DOCUMENTS

| | | | | |
|---|---|---|---|---|
| 8,316,963 | B2 | 11/2012 | Eia et al. | |
| 8,425,684 | B2 | 4/2013 | Hebert | |
| 8,475,604 | B2 | 7/2013 | Clement et al. | |
| 8,651,201 | B2 | 2/2014 | Hollier | |
| 8,741,072 | B2 | 6/2014 | Eia | |
| 2005/0066997 | A1* | 3/2005 | Watford | B08B 3/02 134/10 |
| 2007/0182202 | A1* | 8/2007 | Brenneman | B60J 5/108 296/146.8 |
| 2008/0047587 | A1 | 2/2008 | Ball | |
| 2010/0108319 | A1 | 5/2010 | Hollier et al. | |
| 2011/0253179 | A1* | 10/2011 | Barrios | B08B 3/026 134/115 R |
| 2011/0284027 | A1 | 11/2011 | Logan et al. | |
| 2012/0067372 | A1 | 3/2012 | O'Quinn et al. | |
| 2013/0247939 | A1 | 9/2013 | Chanthavongsy et al. | |

OTHER PUBLICATIONS

Offshore Cleaning Systems; Tank & Vessel Cleaning; Conventional Cleaning; Website article from http://offshorecleaningsystems.com/tank-vessel-cleaning/.

Evergreen Industrial Services; Tank Cleaning Services; Benefits; Website article from http://www.evergreenes.com/index.php/tank-cleaning.

Mi Swaco-A Schlumberger Company; Automatic Tank Cleaning (ATC); Automated system minimizes HSE risks of manual tank cleaning; Website article from http://www.slb.com/services/miswaco/services/fluids_processing/automatic_tank_cleaning.aspx.

* cited by examiner

PORTABLE CONTAINER CLEANING SYSTEM AND APPARATUS

CROSS REFERENCE TO RELATED APPLICATIONS

This application claims priority to U.S. Provisional Patent Application No. 62/095,898, entitled Portable Container Cleaning System and Apparatus, which was filed on Dec. 23, 2014.

STATEMENT REGARDING FEDERALLY SPONSORED RESEARCH OR DEVELOPMENT

Not Applicable.

REFERENCE TO A "SEQUENCE LISTING," A TABLE, OR A COMPUTER PROGRAM

Not Applicable.

BACKGROUND

Drilling operations often produce undesirable byproducts which must be treated or stored in accordance with government regulations. The oil and gas industry is faced with logistical hurdles for transporting, storing, and treating these undesirable byproducts of drilling operations. Typically, these byproducts or contaminants are transported in reusable portable boxes from the drilling sites to facilities which are capable of processing or otherwise storing the byproducts. After the portable boxes are used for transporting the byproducts, they must be thoroughly cleaned of contaminants before being reused.

For example, drill cuttings (or cuttings) comprise the soil, rock fragments, and pulverized material that are removed from a borehole and that may include an amount of fluid (typically a hydrocarbon) that results from a drilling process. During a typical drilling operation, drill cuttings are produced as the rock (earth) is broken by the drill bit advancing through the rock or soil. As drilling fluid or drilling mud circulates up from the drill bit, the cuttings are carried to the surface.

Drilling mud is used in the drilling process for various reasons, many of which do not lead to the subject of the present disclosure. To name a few, however, drilling mud is used to control subsurface pressures, lubricate the drill bit, stabilize the well bore, and, more pertinently to the present disclosure, carry the cuttings to the surface, among other functions. In practice, mud is pumped from the surface through the hollow drill string, exits through nozzles in the drill bit, and returns to the surface through the annular space between the drill string and the walls of the hole, transporting the cuttings in it. Once the cuttings have reached the surface, they must be separated from the mud so that the mud can be reused. The means of separating the drill cuttings from the drilling mud mixture is well known in the art and is not the subject of the present disclosure.

Once separated from the drilling mud mixture, the cuttings must be handled in compliance with government regulations. The separated cuttings are often transported from the drilling site to designated dumping or processing zones for further treatment or more permanent storage. Cuttings boxes, which are well known in the art, are often employed to transport the cuttings offsite to the designated zone.

At the treatment or disposal sites, the boxes are emptied of the cuttings materials, but remain contaminated by the residue cuttings which linger in the box. The boxes must be cleaned of all remaining contaminants prior to returning to the drill sites to be reused. It is typical practice in the industry for a human operator to at least partially enter into the cuttings box to pressure wash the interior. Such actions are subject to heightened government regulations which the industry participants would prefer to avoid or circumvent if economically feasible.

One object of the present portable container cleaning system and apparatus is to remove the need for a human to enter the cuttings box in order to remove the cuttings contaminants from the container walls, thereby foregoing the heightened government regulations previously discussed. Another object of the present invention is to allow for the rapid cleaning of multiple cuttings boxes in order to reduce the downtime of the cuttings box for reuse. Another object of the present invention is to provide a cleaning system and apparatus with a low footprint so that the system can be placed and operated without requiring a large amount of room on a jobsite or in cleaning facility. Other objects of the present invention include reducing the amount of manpower and time required for the cleaning process and reducing the amount of spray water required for cleaning multiple portable boxes.

SUMMARY

Disclosed herein is a portable container cleaning system and apparatus which in at least one embodiment generally comprises a cleaning container comprising at least one cleaning platform lift door unit; a cleaning unit comprising at least one cleaning nozzle; a pump and piping system; and, a filtration system, wherein a portable box is capable of being loaded into a cleaning position inside said cleaning container via said cleaning platform lift door unit for cleaning by said cleaning unit, and said cleaning unit is in fluid communication with said filtration system via said pump and piping system.

DESCRIPTION OF THE DRAWINGS

The drawings constitute a part of this specification and include exemplary embodiments of the portable container cleaning system and apparatus, which may be embodied in various forms. It is to be understood that in some instances, various aspects of the invention may be shown exaggerated or enlarged to facilitate an understanding of the invention. Therefore the drawings may not be to scale.

DETAILED DESCRIPTION

Figure 1:
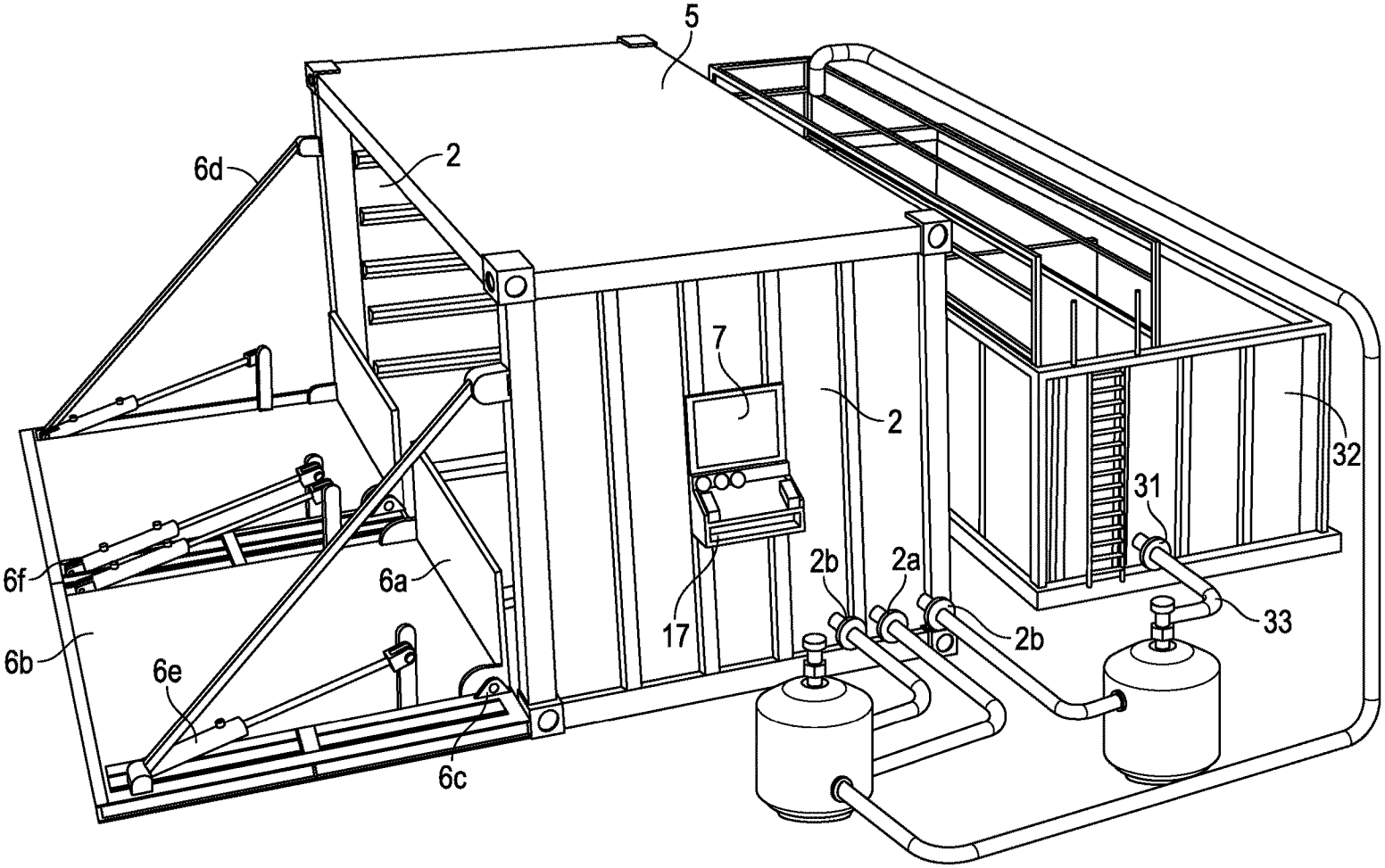
FIG. 1 is a perspective view of the portable container cleaning system and apparatus which generally depicts the external components of the system.

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies. Although the terms "step" and/or "block" or "module" etc. might be used herein to connote different components of methods or systems employed, the terms should not be interpreted as implying any particular order among or between various steps herein disclosed unless and except when the order of individual steps is explicitly described.

Furthermore, the described features, structures, or characteristics may be combined in any suitable manner in one or more embodiments. In the following description, numerous specific details are provided, such as examples of containers, cuttings boxes, cleaning systems, filters, cleaning nozzles, weir tank set ups, filtration systems, and pumps. One skilled in the relevant art will recognize, however, that various embodiments of the portable container cleaning system and apparatus may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment. Other steps and methods may be conceived that are equivalent in function, logic, or effect to one or more steps, or portions thereof, of the illustrated portable container cleaning system and apparatus. Additionally, the format and symbols employed are provided to explain the logical steps of cleaning that employs an embodiment of the current system and apparatus and are understood not to limit the scope of the method or apparatus itself. Although various arrow types and line types may be employed in the flow chart diagrams, they are understood not to limit the scope of the corresponding method or apparatus itself. Indeed, some arrows or other connectors may be used to indicate only the logical flow of the cleaning process for that particular embodiment. For instance, an arrow may indicate a waiting or monitoring period of unspecified duration between enumerated steps of the depicted cleaning. Additionally, the order in which a particular method occurs may or may not strictly adhere to the order of the corresponding steps shown.

A portable container cleaning system and apparatus is disclosed herein which in at least one embodiment generally comprises a cleaning container with loading doors to accommodate emptied cuttings boxes wherein said emptied cuttings boxes are cleaned, cleaning equipment, a water filtration system in fluid connection with said cleaning equipment, and at least one pump in fluid connection with said water filtration system.

Figure 8:
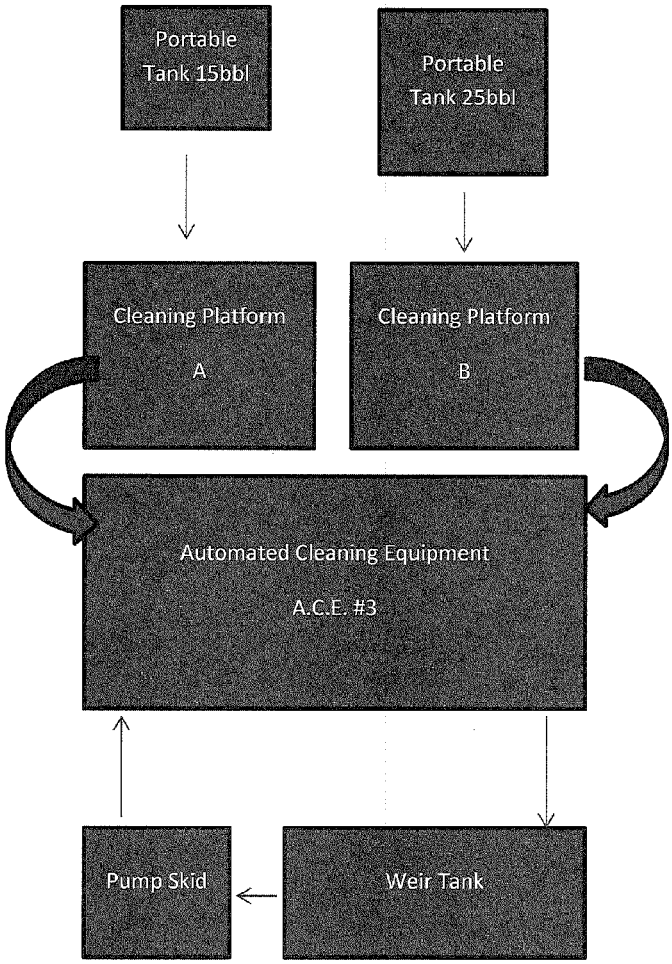
FIG. 8 is a logical flow diagram showing a method of using the portable container cleaning system and apparatus.

FIG. 8 presents a general overlay of a method of cleaning that employs a generic embodiment of the portable container cleaning system and apparatus so as to aid in describing its function and utility. Turning specifically to FIG. 8, it is shown that portable boxes such as cuttings boxes are loaded onto its corresponding cleaning platform which forms a portion of the cleaning container. Once the portable boxes are loaded onto the cleaning platform, the platform is moved at a substantially ninety degree angle such that the portable box is moved inside the cleaning container and the cleaning platform forms a wall of the cleaning container. Next, cleaning equipment, which may or may not be automated, is employed to clean the inside of the portable boxes to remove substantially all of the contaminants which may reside inside the container in the form of a contaminated slurry. From here, the process follows a dual track: one for purifying the contaminated slurry so that the cleaning water can be recirculated for the next cleaning and another for the removal of the now substantially cleansed portable box so that a new box can be loaded for cleaning.

The removed contaminants and spent water form a contaminated slurry which falls from the portable boxes onto the floor of the containers. A piping system in fluid connection with a pump comprises at least one inlet which inlet resides in substantial proximity to the floor of the container whereby the contaminated slurry falls. The pump pulls the contaminated slurry out of the cleaning container whereby it is transported into a filtration system, which as depicted comprises a weir tank for separating substantially all of the contaminants from the water in the contaminant slurry. The filtered water is then transported via a pump back into the cleaning system whereby it is reused to clean the inside of another portable box. Furthermore, once the portable box is at least substantially cleansed of the targeted contaminants, the cleaning platforms are lowed such that they return to the receiving state so that the now-cleansed portable box can be removed from the system and returned to storage or for their next designated use. The cleaning system and apparatus is then ready to load another contaminated portable box for cleaning.

Figure 2:
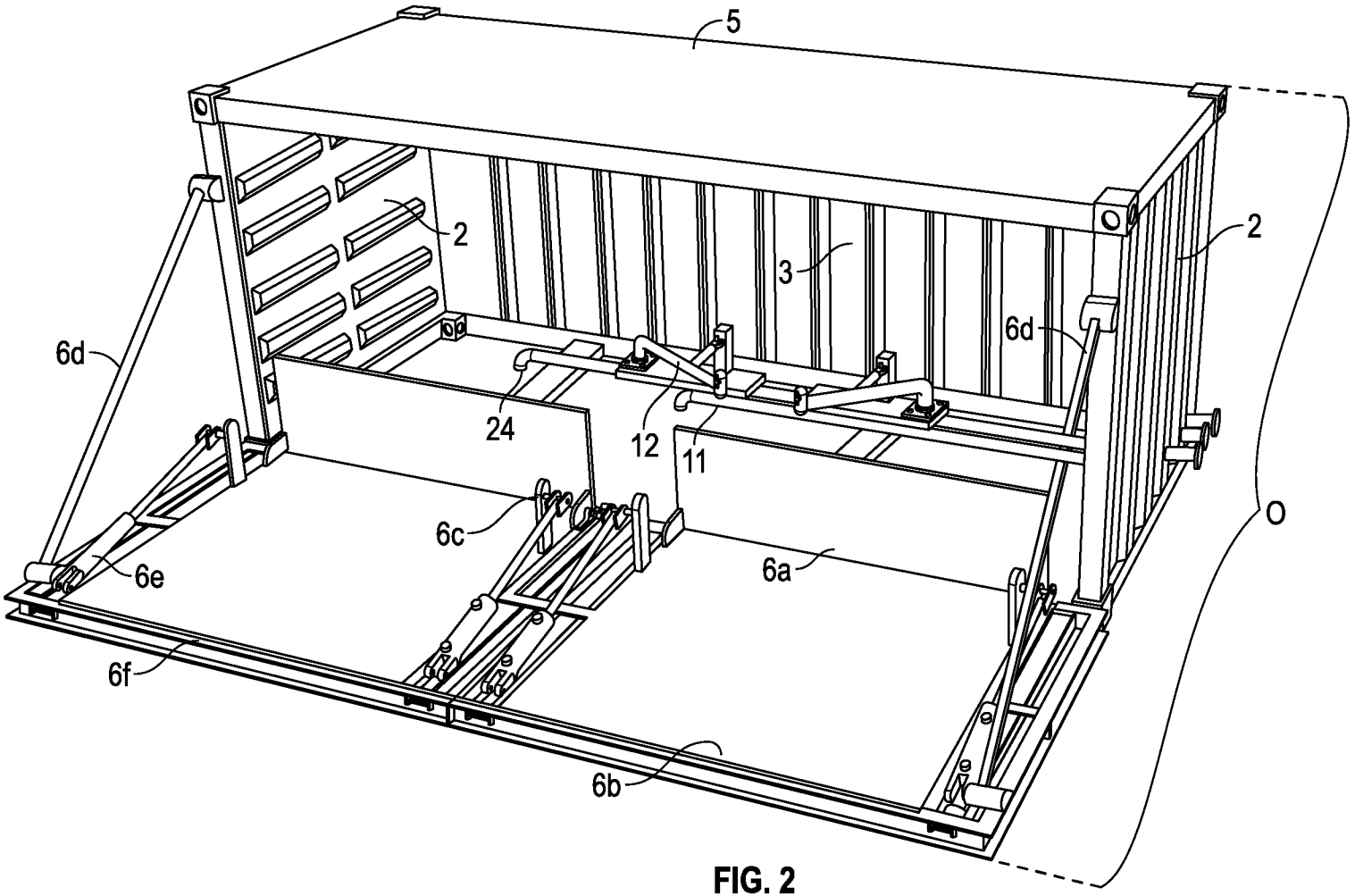
FIG. 2 is a side view of the portable container cleaning system and apparatus with the cleaning platform lift door units in the loading position so as to show the internal components of the system.
Figure 3:
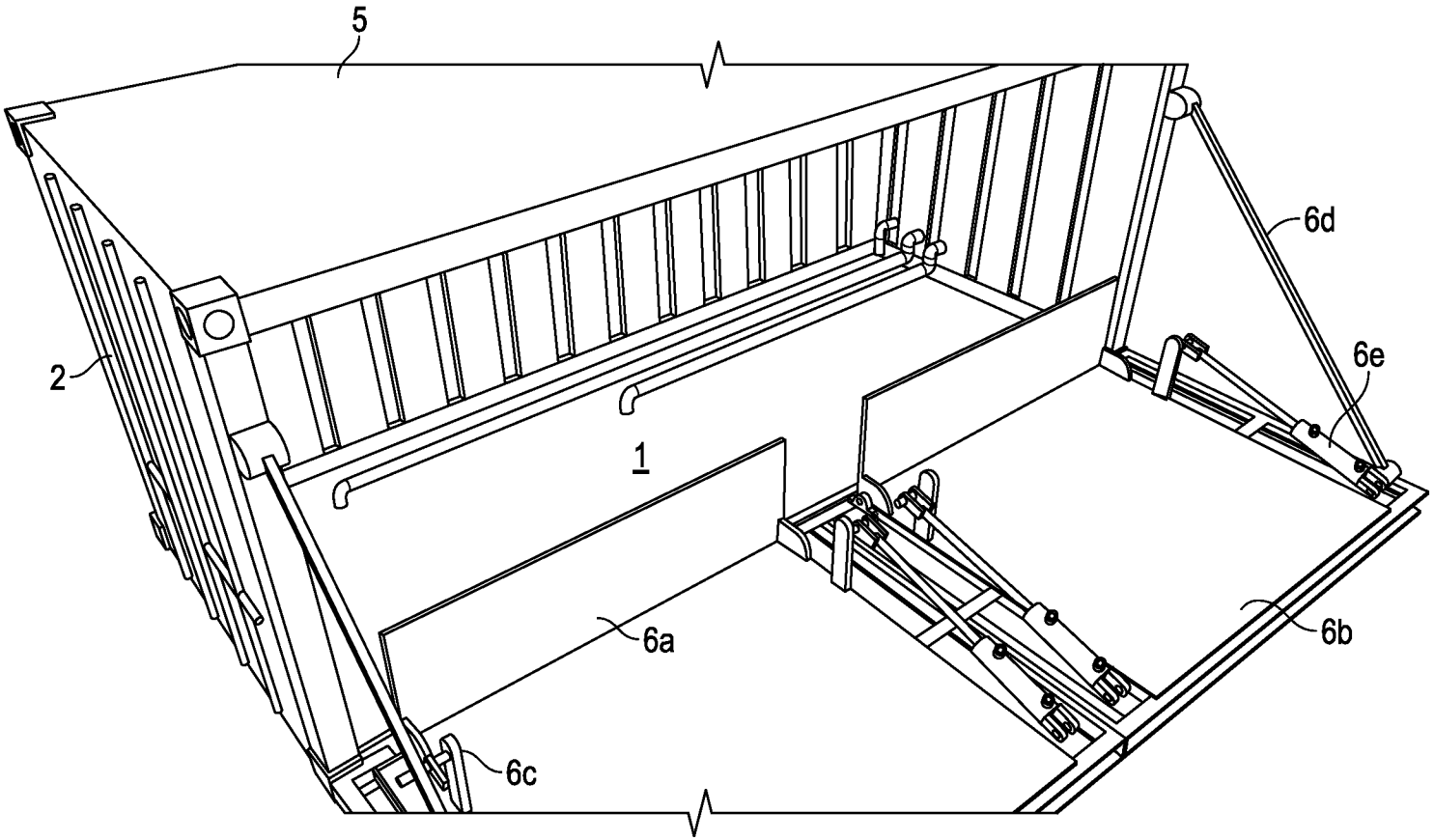
FIG. 3 is a perspective view of the portable container cleaning system and apparatus which shows the placement of the piping system inside the container unit.
Figure 4:
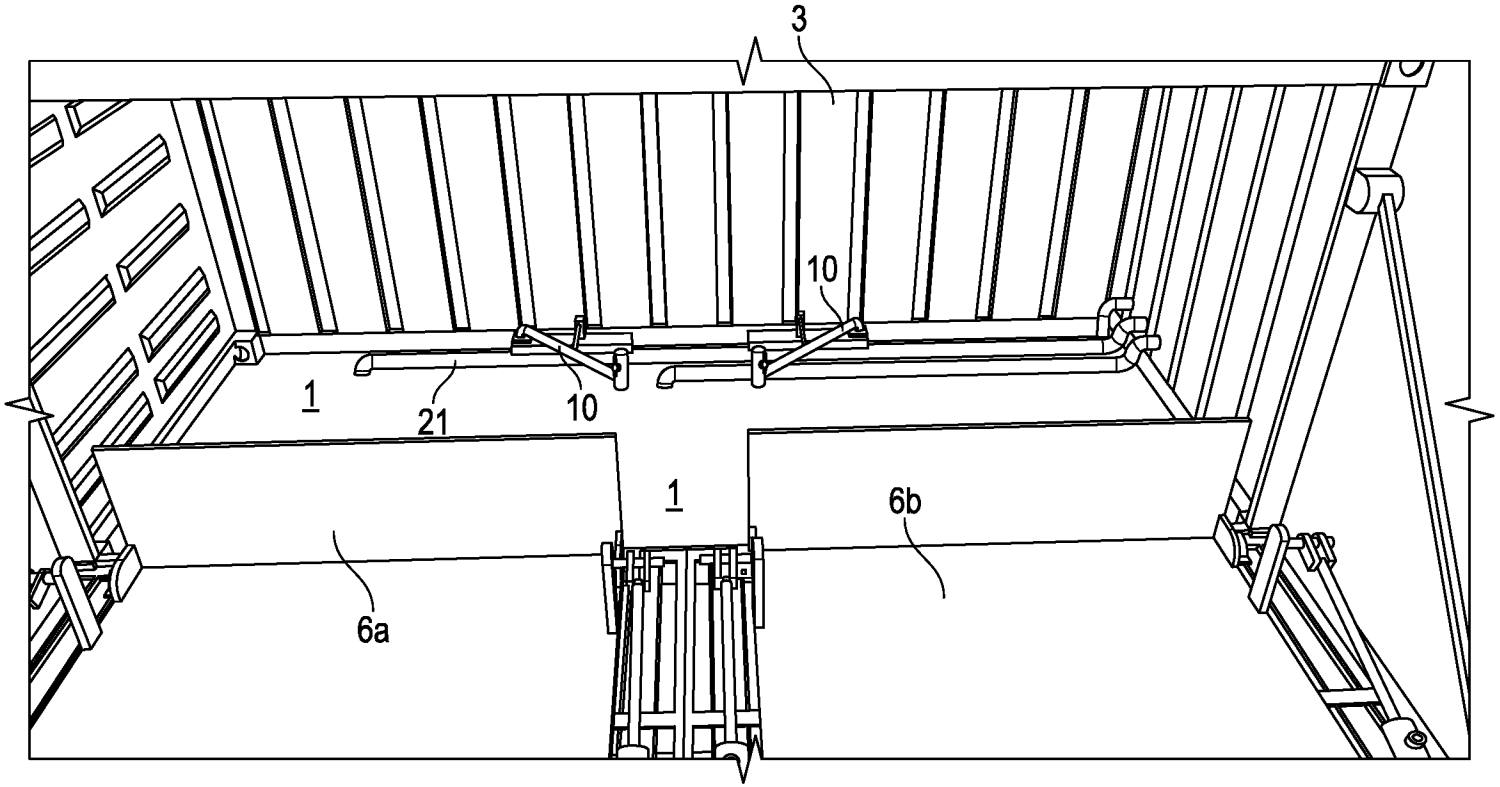
FIG. 4 is a perspective view of the portable container cleaning system and apparatus which shows the placement of cleaning units in relation to the piping system.

Turning to FIG. 1, a general overlay of a portable container cleaning system and apparatus is shown which comprises, generally, a container unit 0, cleaning units 10, a pump and piping system 20, and a filtration system 30 for use in cleaning contaminants out of portable box 40 such as a cuttings box. Turning specifically to FIG. 2, the components of the container unit 0 are more clearly distinguished. Container unit 0 comprises a substantially box-like structure which as depicted resembles the size and shape of a typical shipping container as would be readily recognizable by those familiar in the art although various shapes and container-like objects could be used. As depicted, the container unit 0, structure comprises a container base 1, a set of opposing side walls 2, a rear wall 3, a receptor opening 4 opposing the rear wall 3, and a container top 5. The side walls 2 and rear wall 3 extend vertically from the container base 1 to the container top 5. Receptor opening 4 is an opening in the wall opposing the rear wall 3 through which portable box 40 is capable of being loaded into a cleaning position inside the container. As depicted in the figures, receptor opening 4 spans an entire longitudinal side of the container unit 0 so as to accommodate the loading of one or more portable boxes. The container unit 0 and its components can be formed of a multitude of appropriate materials capable of providing the requisite structural support such as various metals, alloys, and polymers including steel, stainless steel, iron, hardened plastics, and the like.

At least one cleaning platform lift door unit 6 is attached to the container unit 0 at the receptor opening 4 which will be used to load and unload portable boxes 40 into and from the cleaning position so that the portable box 40 can be cleaned by the cleaning unit 10. As depicted in the figures, a pair of cleaning platform lift door units 6 is utilized and connected to container unit 0 so as to allow the simultaneous loading and cleaning of two portable boxes 40 into the cleaning unit 0. Remaining on FIG. 2, it is shown that each cleaning platform lift door unit 6 comprises a lift door catch 6*a* and lift door loading platform 6*b* with a flashing 6*f* around the outer edges of loading platform 6*b* wherein lift door catch 6*a* is attached substantially orthogonal to the lift door loading platform 6*b* such that the overall cleaning platform lift door unit 6 has a cross section substantially in the shape of an "L". In various embodiments, the cleaning platform lift door unit 6 will evidence an angle between the lift door loading platform 6*b* and the lift door catch 6*a* of approximately 80-100 degrees. The cleaning platform lift door unit 6 is attached to the container unit 0 via hinges 6*c* and hinge arms 6*d*. Hinges 6*c* and hinge arms 6*d* connect cleaning platform lift door unit 6 in such that they work in concert so as to allow the cleaning platform lift door unit 6 to rotate substantially 90 degrees between two key positions: from a "loading position" wherein the lift door loading platform 6*b* is substantially parallel to the container base 1 and lift door catch 6*a* is substantially orthogonal to the container base 1 to a "cleaning position" wherein the lift door loading platform 6*b* is substantially orthogonal to the container base 1 and lift door catch 6*a* is substantially parallel to the container base 1 and, in some embodiments will at least partially rest on the container base 1 or a platform which itself rests on the container base 1. In alternate embodiments, the term "loading" position may refer to a position wherein the lift door is disposed towards the ambient environment such that a portable box 40 can be loaded onto the cleaning platform lift door unit 6, and the term "cleaning" position may refer to a position wherein the cleaning platform lift door unit 6 is disposed towards the interior of the container, thereby allowing a portable box 40 loaded onto the cleaning platform lift door unit 6 to be cleaned by the internal cleaning unit 10. In the embodiment as depicted in FIGS. 1-4, a hydraulic lift 6*e* is attached to the container unit 0 and cleaning platform lift door unit 6 so as to aid in the controlled rotation from the loading position to the cleaning position and from the cleaning position to the loading position. When the cleaning platform lift door unit 6 is in the cleaning position, lift door loading platform 6*b* and flashing 6*f* form a partial seal of the opening in container unit 0 formed by receptor opening 4 so as to prevent a substantial amount of contaminant slurry from escaping the container unit 0 when in operation.

Figure 5:
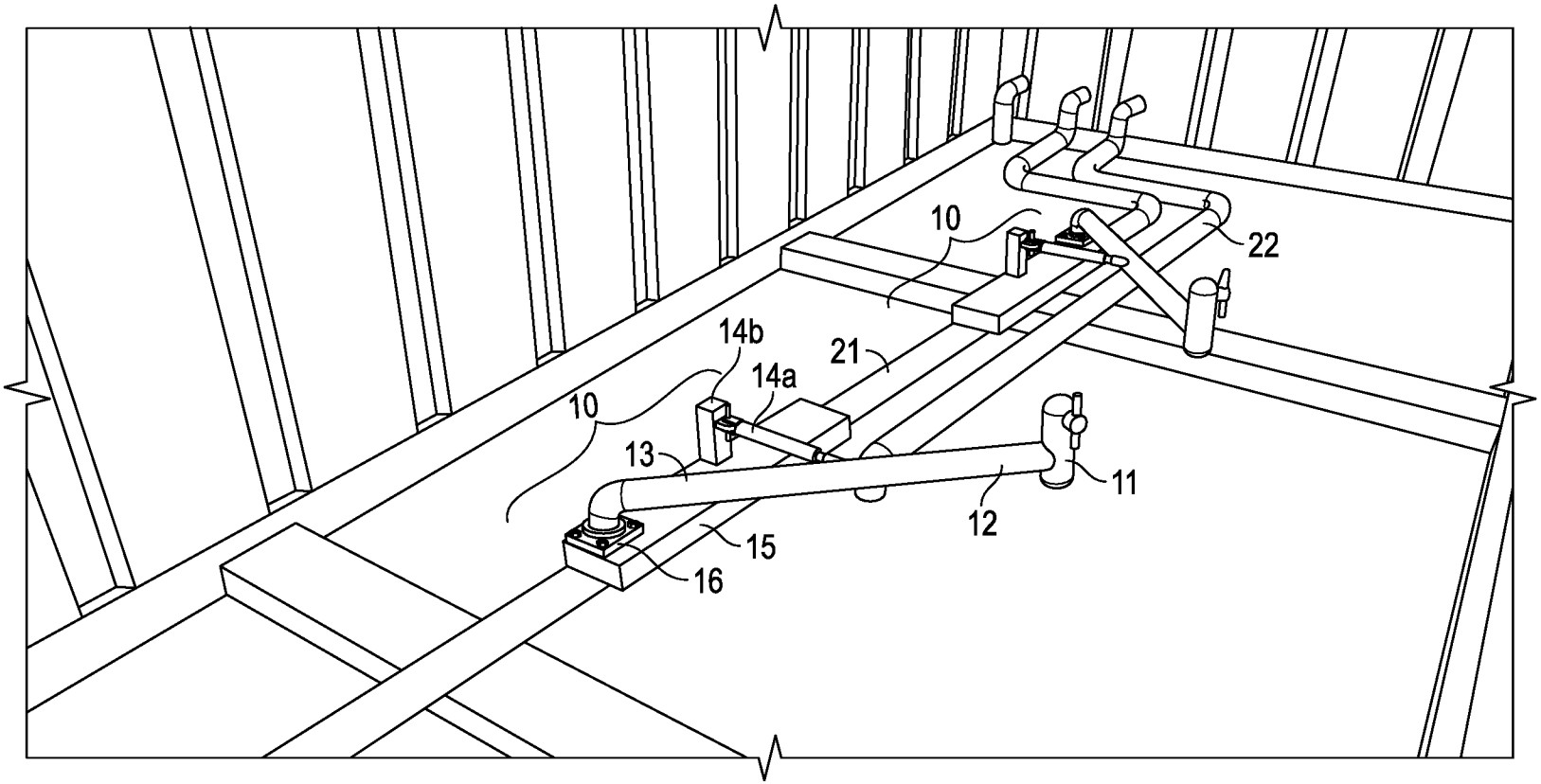
FIG. 5 is a close up view of the cleaning units.

Turning now to FIG. 5 specifically, it is shown that each cleaning unit 10 comprises at least one cleaning nozzle 11, an extension arm 12, a swivel 13, a hydraulic unit 14, a cleaning unit platform 15 and a mounting plate 16 in a manner such that the at least one cleaning nozzle 11 is in fluid communication with the water intake pipe 21. The number of cleaning units 10 employed may depend on the number of portable boxes 40 the embodiment is set up to clean at a given time or the type or size of the portable boxes to be cleaned. As depicted, cleaning unit platform 15 is a substantially longitudinal platform attached to water intake pipe 21 that connects the cleaning unit 10 components to the water intake pipe 21. Cleaning nozzle 11 is attached to one end of extension arm 12 while the other end of the extension arm 12 is attached to swivel 13. Swivel 13 is connected to cleaning unit platform 15 via mounting plate 16 which is removably attached to cleaning unit platform 15 via fasteners such as bolts (not depicted). Hydraulic unit 14 comprises a hydraulic unit base 14*b* and a hydraulic arm 14*a* which is a hydraulic davit arm capable of being controllably extended outward and retracted inward from the hydraulic unit base 14*b*. The hydraulic unit base 14*b* is mounted to cleaning unit platform 15 while hydraulic arm 14*a* is attached to extension arm 12 such that when hydraulic arm 14*a* extends outwards from hydraulic unit base 14*b*, it causes extension arm 12 to rotate on swivel 13 so as to project the cleaning nozzle 11 away from cleaning unit platform 15. Such extension of the hydraulic arm 14*a* allows for the cleaning nozzle 11 to enter into the portable box 40 for cleaning. Cleaning nozzle 11 comprises a series of water spigots which are arranged such that when the cleaning nozzles 11 are engaged, water from water intake pipe 21 travels through the extension arm 12 and into the cleaning nozzle 11 whereby the water is sprayed through the spigots such that it cleans substantially the entirety of the portable box 40 interior. When the cleaning process is completed, the hydraulic arm 14*a* retracts towards the hydraulic unit base 14*b*, pulling the extension arm 12 and cleaning nozzle 11 towards the hydraulic unit base 14*b* and out of the portable box 40. In the embodiment as depicted, a control unit 17 can be employed in order to control the components of the cleaning unit 10 to perform their cleaning function. Furthermore, in an embodiment such as the one depicted wherein a control unit 17 in communication with the various components of the system and apparatus is employed, container unit 0 further comprises a viewing portal 7 through which a user can view the contents of the container unit 0 in order to be able to properly control cleaning unit(s) 10 via the control unit 17. In alternate embodiments, one or more cameras linked to one or more external screens may be mounted within container unit 0 in order to facilitate the operators view inside the container unit 0.

The system employs closed loop water system which uses pump and piping system 20 to circulate contaminated slurry out of the container unit 0 for treatment and filtering by filtration system 30 and clean water from filtration system 30 into the cleaning units 10. Doing so helps to minimize the waste water cycle, allowing for continuous operation of the system even in various environments where access to water may be limited. Essentially, pump and piping system 20 and filtration system 30 work in concert to pump clean water into the cleaning system and contaminated slurry out of the system for cleaning as needed for the continuous operation of the cleaning system and apparatus. Filtration system 30 comprises a plurality of outlet filters 31 including outlet filter 31 and intake filter 33 for manual filtration and a weir tank 32 which is a conventional multi-chambered weir tank 32 well known in the art used for separation by gravity in order to separate contaminants from the water to be recycled for cleaning. Numerous types of filters could be used in the construction and application of the present portable box cleaning system and apparatus. For example, as depicted, long cylindrical sock filters are employed for outlet filter 31 and intake filter 33. Weir tank 32 further doubles as a reservoir for the water to be used by the system. Pump and piping system 20 comprises at least one water intake pipe 21, at least one slurry outlet pipe 22, and one or more pumps. As depicted, a water intake pipe 21 is the conduit through which cleaning units 10, water intake pump 23, and weir tank 32 are in fluid communication. Clean water is pumped by water intake pump 23 out of weir tank 32, through intake filter 33 and into the cleaning units 10 via water intake pipe 21 whereby the water is sprayed from the cleaning nozzle 11 into the portable box 40. Intake filter 33 is an additional layer of filtration used to remove contaminants which may remain in the water stream after undergoing gravity filtration in the weir tank 32. Contaminated slurry, on the other hand, is collected by the intake of slurry outlet pipe 22 and pumped by outlet pump 24 out of the container unit 0 whereby it is passed through outlet filter 31 and into weir tank 32 for gravity filtration.

Method for use: Provided herein for illustrative purposes is a description of a method using the currently described embodiment of the cleaning system and apparatus to clean a single portable box of contaminated residues. It should be noted that the discussed method should not be deemed to so limit the scope of the presently described system and apparatus as many embodiments of the cleaning system and apparatus, including the embodiment depicted in the figures, are capable of cleaning one or more portable boxes either simultaneously or in rapid succession.

Turning to FIGS. 1-4, a portable box cleaning system and apparatus is provided where each of the two cleaning platform lift door units 6 is in the loading position, ready to receive a portable box 40. Typically, a majority of the contaminated contents housed would be removed from portable boxes 40 before application of the portable box cleaning apparatus. Under such use, the apparatus acts to rinse the remaining contaminant residue which remains in the portable box 40 before it can be reused in the field to transport further contaminants.

As depicted in the figures for illustrative purposes, portable box 40 is a typical 25 barrel (bbl) cuttings box well known in the art which comprises a portable box opening 41, a portable box door 42 which corresponds with said portable box opening 41, a portable box base 44 which opposes the portable box opening 41, and a plurality of portable box side walls 45. Although a 25 bbl cuttings box is employed in the instant example, the system and apparatus is designed to treat numerous types of portable boxes of various shapes and sizes and is capable of treating different types, shapes, or sizes of portable boxes simultaneously. To prepare the portable box 40 for cleaning, users open portable box doors 42 exposing the contents of the portable box 40 through portable box opening 41. In at least one embodiment, portable box doors 42 are fastened in the open position to facilitate the cleaning via securing pins 43.

Figure 6:
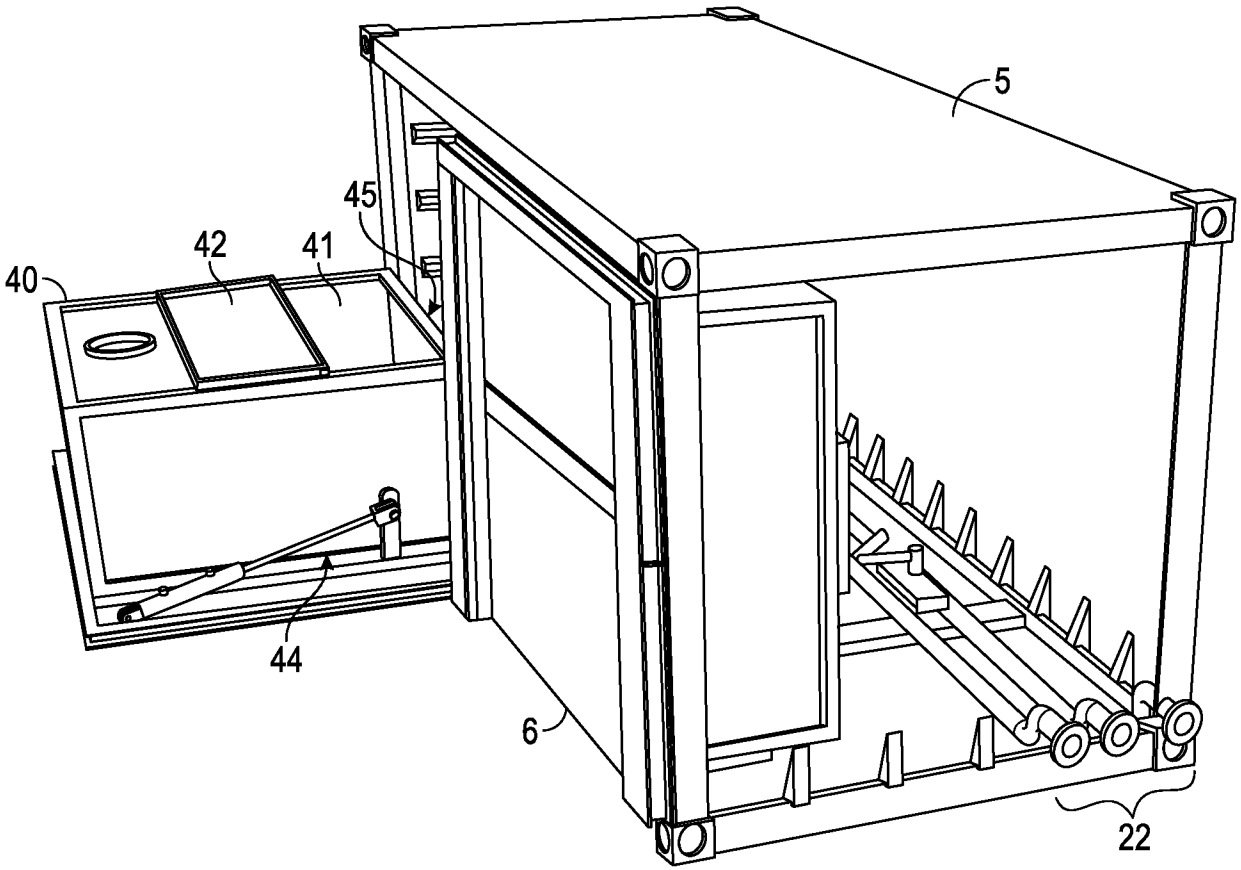
FIG. 6 is a cut-out side view of the portable container cleaning system and apparatus showing one portable box in the loading position and one portable box in the cleaning position.

Once ready for final cleaning and rinsing, the portable box 40 is transported to the portable container cleaning apparatus via external means such as a fork lift (not depicted). Turning to FIG. 6, it is shown that portable box 40 is loaded onto the cleaning platform lift door unit 6 such that the portable box base 44 rests on the lift door loading platform **6*b* with portable box opening 41 exposed opposite the portable box base 44. As further depicted, one of the portable box side walls 45 contacts and rests against lift door catch 6*b*. The portable box 40 is secured to the platform via a portable box securing means 46 (not depicted) so as to prevent the portable box 40 from moving when the portable box 40 and cleaning platform lift door unit 6 are moved to the cleaning position. This securing means may include straps, pins, bolts, or other mechanical securing means, or, in alternate embodiments, the weight of the portable box 40** may act to secure it in position.

When the portable box 40 is secured to the cleaning platform lift door unit 6, the portable box 40 is ready to be moved to the cleaning position. Rotational means such as a fork lift or motor (not depicted) are employed to rotate the portable box 40 and cleaning platform lift door unit 6 along the hinges **6*c* and hinge arms 6*d* substantially 90 degrees from the loading position into the cleaning position. In the cleaning position, the lift door loading platform 6*b* is substantially orthogonal to the container base 1 and lift door catch 6*a* is substantially parallel to the container base 1 causing portable box opening 41 to face the cleaning unit 10 housed inside the container unit 0**.

Figure 7:
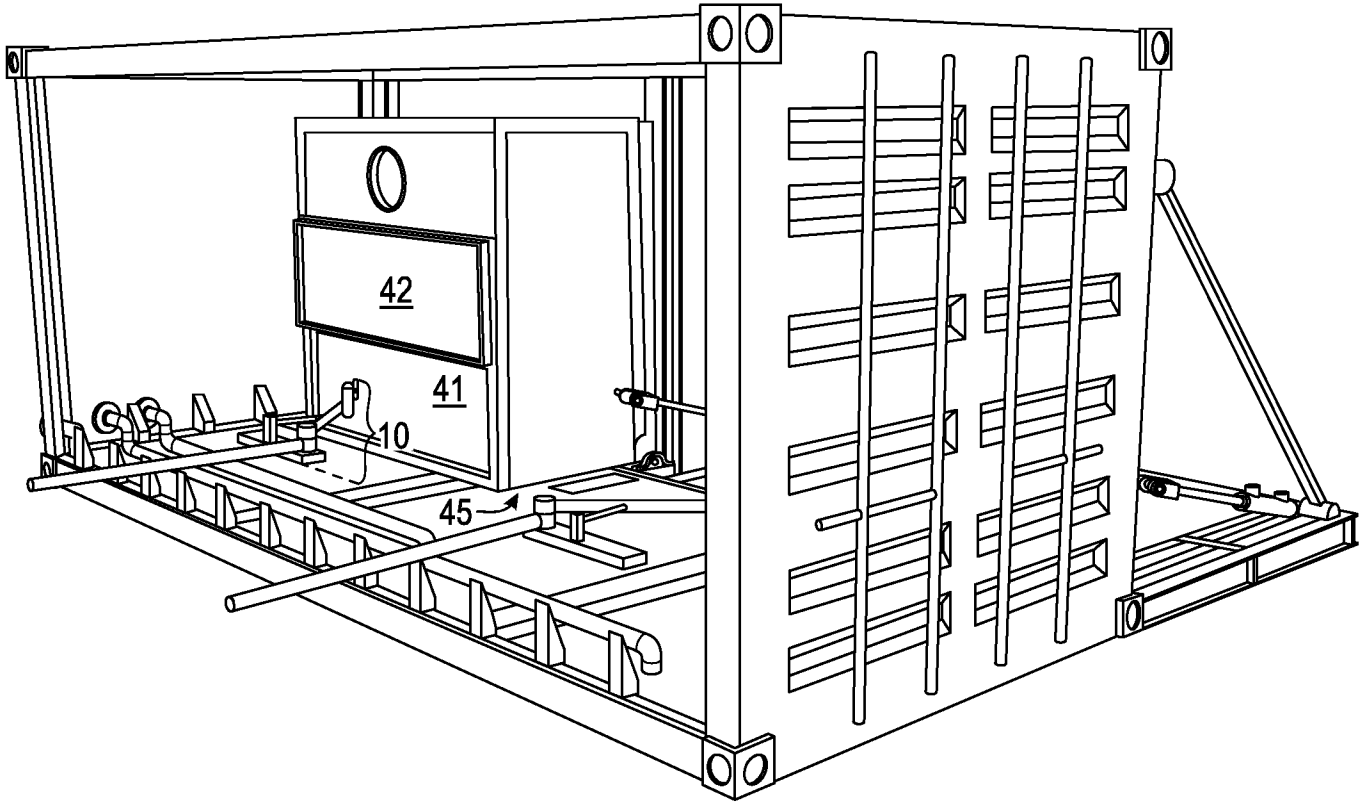
FIG. 7 is a rear view of the same image in FIG. 6 in order to show the location of the cleaning unit when operating.

An external operator is capable of viewing the contents of the container unit 0 through viewing portal 7 or other viewing means such as cameras and screens. When the operator sees that the portable box 40 is in the cleaning position, the operator can employ control unit 17 situated substantially adjacent to viewing portal 7 to control the cleaning unit 10. From his vantage point at viewing portal 7, the operator causes hydraulic arm **14*a* of hydraulic unit 14 to extend outward from hydraulic base 14*b*, causing the extension arm 12 to rotate along swivel 13 such that the cleaning nozzle 11 enters into the portable box opening 41 as seen in FIG. 7. In an alternate embodiment, the hydraulic unit 14 could act by retracting, thereby pulling the extension arm 12 such as to move cleaning nozzle 11 into position. With the cleaning nozzle 11 in place inside the portable box 40, the operator can use control unit 17 to operate water intake pump 23 to pump water from weir tank 32, through intake filter 33, and into cleaning unit 10 via water intake pipe 22. Once the water enters the cleaning unit 10, it passes through swivel 13 into extension arm 12 and out the spigots which comprise cleaning nozzle 11 which are prearranged so that the spray hits the interior of the portable box 40, removing the contaminant residue from the interior in the form of contaminated slurry. Different nozzle tools may be used depending on the product or substance to be cleaned. When the spraying process is completed, the cleaning platform lift door unit 6 is tipped inwards via the rotational means so as to cause substantially all of the contaminated slurry to vacate the portable box 40 and fall to the container base 1 of the container unit 0 which effectively acts as a drip pan for the contaminated slurry. Once substantially all of the contaminated slurry is removed from the portable box 40, the cleaning platform lift door unit 6 is rotated from the cleaning position back to the loading position. When so returned to the loading position, the portable box 40 is unsecured from the cleaning platform lift door unit 6 and transported from the cleaning apparatus via a fork lift. The portable box 40 is allowed to dry and is ready for reuse for transportation of contaminants, while the cleaning system is ready for another portable box 40**.

As previously discussed, the cleaning apparatus further utilizes an outtake system comprising an outlet pump 24 and one or more slurry outlet pipes 22 to remove the contaminated slurry from the container unit 0 for further treatment by filtration system 30 which one or more filters, such as a 10 micron intake filter 33 and a 100 micron outlet filter 31, which act in concert with the gravity filtration provided by weir tank 32 to filter the contaminants out of the contaminated slurry. When ready, the operator activates outlet pump 24, causing the contaminated slurry to be collected in the intake(s) of the one or more slurry outlet pipes 22 whereby the contaminated slurry drains or is actively pumped/transported out of the container unit 0 and into filtration system 30. As shown, one or more slurry outlet pipes 22 pass into and out from the container unit 0 through one or more outlet openings **2*a*. From the container base 1 of the container unit 0, the contaminated sludge is run through an outlet filter 31, which is a 100 micron filter used to separate some of the contaminants from the water stream, and into weir tank 32, a typical multi-chambered weir tank 32 whereby further contaminants are removed by gravity filtration as the water passes through the chambers of the weir tank 32. The decontaminated water is stored in the weir tank reservoir for the next cleaning cycle, whereby it will pass through a final filter, the intake filter 33, to remove any remaining contaminants prior to use by the cleaning units 10**.

In an alternate embodiment of a portable box cleaning system and apparatus, the water intake pipe 21 is a flexible hose which acts as a conduit between the reservoir in weir tank 32 and the cleaning unit 10 such that cleaning nozzle 11 is in fluid communication with the reservoir in the weir tank 32. In such an embodiment, water intake pipe 21 is a flexible hose which enters the container unit 0 through one or more intake openings 2*b* and connects directly to the extension arm 12. As such, the clean water would pass directly from water intake pipe 21 into the extension arm 12 and out cleaning nozzle 11. To accommodate this structure, swivel 13 is a T-shaped joint comprising a longitudinal pivot extension and tubular socket substantially perpendicular to the pivot extension which connects extension arm 12 to the mounting plate 16 of cleaning unit platform 15. The pivot extension portion is connected on one end to the mounting plate 16 and on the other end to the tubular socket portion. Extension arm 12 is placed through the tubular socket portion whereby it is mounted or otherwise fastened to the swivel 13. Water intake pipe 21 is connected to the free end of the extension arm 12 opposite the cleaning nozzle 11. During operation, hydraulic unit 14 would work in the same manner as previously described, causing the hydraulic unit 14 comprising of an extension arm 12 and cleaning nozzle 11 to rotate along the swivel 13 so as to maneuver the cleaning nozzle 11 into and out of position for cleaning as needed. Water would be pumped by water intake pump 23 from weir tank 32 through intake filter 33 for a final filtration before use in the cleaning apparatus. From intake filter 33, the filtered water stream is pumped through water intake pipe (a flexible hose) 21, and directly into the inlet of extension arm 12 and into the cleaning nozzle 11 whereby the water is sprayed into the portable box 40 to clean the inside walls of the portable box 40.

For the purpose of understanding the portable container cleaning system and apparatus, references are made in the text to exemplary embodiments of a portable container cleaning system and apparatus, only some of which are described herein. It should be understood that no limitations on the scope of the invention are intended by describing these exemplary embodiments. One of ordinary skill in the art will readily appreciate that alternate but functionally equivalent components, materials, designs, and equipment may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

Reference throughout this specification to features, advantages, or similar language does not imply that all of the features and advantages that may be realized should be or are in any single embodiment. Rather, language referring to the features and advantages is understood to mean that a specific feature, advantage, or characteristic described in connection with an embodiment is included in at least one embodiment. Thus, discussion of the features and advantages, and similar language, throughout this specification may, but do not necessarily, refer to the same embodiment.

Furthermore, the described features, advantages, and characteristics may be combined in any suitable manner in one or more embodiments. One skilled in the relevant art will recognize that the portable container cleaning system and apparatus may be practiced without one or more of the specific features or advantages of a particular embodiment. In other instances, additional features and advantages may be recognized in certain embodiments that may not be present in all embodiments.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change to the basic function to which it is related.

COMPONENT LIST FOR DEPICTED EMBODIMENT

0—container unit
1—container base
2—side walls
2*a*—outlet opening
2*b*—intake opening
3—rear wall
4—receptor opening
5—container top
6—cleaning platform lift door unit
6*a*—lift door catch
6*b*—lift door loading platform
6*c*—hinges
6*d*—hinge arms
6*e*—hydraulic lifts
6*f*—flashing
7—viewing portal
10—cleaning unit
11—cleaning nozzle
12—extension arms
13—swivel
14—hydraulic unit
14*a*—hydraulic arms
14*b*—hydraulic unit base
15—cleaning unit platform
16—mounting plate
17—control unit
20—pump and piping system
21—water intake pipe
22—slurry outlet pipe
23—water intake pump
24—outlet pump
30—filtration system
31—outlet filter
32—weir tank
33—intake filter
40—portable box
41—portable box opening
42—portable box door
43—securing pins
44—portable box base
45—portable box side walls
46—portable box securing means

I claim:

1. A portable container cleaning apparatus comprising:

(a) a cleaning container unit, (b) at least one cleaning platform lift door unit upon which a portable container can be loaded, said cleaning platform lift door unit comprising a loading platform connected at least substantially orthogonally to a lift door catch on one end of the loading platform, and wherein said cleaning platform lift door unit is connected to said cleaning container unit via at least one hinge positioned substantially near the connection point between the loading platform and the lift door catch;

(c) a cleaning unit comprising at least one cleaning nozzle;

(d) a pump and conduit system comprising at least one pump and one conduit; and (e) filtration system, wherein said cleaning platform lift door unit rotates along said at least one hinge to position the portable container between a loading position and a cleaning position, such that at least a portion of the portable container rests on the lift door catch when the portable container is in the cleaning position, and at least a portion of the portable container rests on the loading platform when the portable container is in the loading position, and wherein said cleaning unit is in fluid communication with said filtration system via said pump and conduit system; and wherein the nozzle is operationally positionable such that it can spray fluids into the portable container when the portable container is in the cleaning position.

2. The portable container cleaning apparatus as in claim 1 wherein the at least one cleaning platform lift door unit further comprises a lift door catch and a lift door loading platform.

3. The portable container cleaning apparatus as in claim 2 wherein the lift door catch and lift door loading platform are substantially orthogonally connected to each other such that they are connected at an angle of between 80 to 100 degrees.

4. The portable container cleaning apparatus as in claim 2 wherein the cleaning platform lift door unit has a cross section in the shape of an "L" when said lift door unit is in said loading position.

5. The portable container cleaning apparatus as in claim 1 wherein the at least one cleaning platform lift door unit is connected to a hydraulic lift which aids in moving the cleaning platform lift door unit between the loading and cleaning positions.

6. The portable container cleaning apparatus as in claim 1 wherein the cleaning unit comprises at least one cleaning nozzle in fluid communication with a water intake pipe that connects the cleaning nozzle to a fluid reservoir for use in cleaning.

7. The portable container cleaning apparatus as in claim 6 wherein the cleaning nozzle is disposed on an extension arm which is capable of moving the cleaning nozzle into and out of the portable container for cleaning.

8. The portable container cleaning apparatus as in claim 7 wherein the cleaning unit further comprises a hydraulic unit connected to the extension arm which can be actuated to move the cleaning nozzle into and out of the portable container.

9. The portable container cleaning apparatus as in claim 1 wherein the cleaning system and the filtration system form a closed loop system.

10. The portable container cleaning apparatus as in claim 1 wherein the filtration system separates contaminants from cleaning fluid, wherein the filtration system comprises at least one filter and a reservoir, and wherein the reservoir is in fluid communication with both the cleaning system and the cleaning unit.

11. The portable container cleaning apparatus as in claim 10 wherein the reservoir comprises a weir tank.

12. The portable container cleaning apparatus as in claim 10 wherein the filtration systems comprises a multi-chambered weir tank that acts as a reservoir and a filter that uses gravity to separate at least some contaminants from cleaning fluid to be recycled for cleaning.

13. The portable cleaning apparatus as in claim 10 wherein the at least one filter comprises at least one cylindrical sock filter.

14. The portable cleaning apparatus as in claim 1 further comprising a control unit exterior to the portable cleaning apparatus and a viewing means that allows a user to view into the cleaning container unit.

15. The portable cleaning apparatus as in claim 14 wherein the control unit is capable of controlling at least one component selected from the group comprising the pump, the lift door unit or the cleaning unit.

16. The portable cleaning apparatus as in claim 15 wherein the viewing means comprises at least one window in proximity to the control unit.

17. The portable cleaning apparatus as in claim 16 wherein the viewing means comprises at least one camera in communication with a video screen in proximity to the control unit.

18. A portable container cleaning apparatus comprising:

(a) a cleaning container unit comprising at least one cleaning platform lift door unit that further comprises a lift door catch and lift door loading platform connected to each other at an angle of between 80 to 100 degrees wherein said lift door catch is a plate and wherein a portable container is capable of being loaded onto the at least one cleaning platform lift door and cleaning platform lift door is capable of moving to a loading position and a cleaning position such that said portable container is substantially supported by said lift door catch when said cleaning platform lift door is moved from said loading position to said cleaning position;

(b) a reservoir for holding cleaning fluid;

(c) at least one cleaning nozzle;

(d) at least two pumps, wherein at least one pump is in fluid communication with the at least one cleaning nozzle and the reservoir via at least one water intake conduit and another at least one pump is in fluid communication with a drain in the cleaning container unit and the reservoir via at least one water outlet conduit;

(e) a filter connected to said water intake conduit for filtering contaminants from said cleaning fluid;

(f) a control unit capable of communicating with at least one pump; and, (g) a viewing means whereby a user can view the interior of the cleaning container unit.

19. The portable container cleaning apparatus of claim 18 wherein the cleaning container comprises at least two cleaning platform lift doors, wherein the cleaning container unit comprises at least two cleaning nozzles whereby at least one cleaning nozzle is capable of entering into and out of a portable container loaded onto each of said at least two cleaning platform lift doors.

20. The portable cleaning apparatus of claim 19 wherein at least one cleaning nozzle is disposed on an extension arm which is capable of moving the cleaning nozzle into and out of the designated portable container for cleaning and wherein a hydraulic unit is connected to the extension arm which can be actuated to move the cleaning nozzle into and out of the at least one portable container, wherein the control unit is in communication with the hydraulic unit so as to be able to actuate the hydraulic unit which in turn moves the cleaning nozzle.

21. The portable container cleaning apparatus of claim 1 wherein said lift door catch is a plate large enough to counteract the weight of said portable container, said portable container being selected from the group consisting of a cuttings box, an industrial byproducts container, an industrial contaminants container, and an industrial reusable portable box.

* * * * *